US005435391A

United States Patent [19]

Jones

[11] Patent Number: 5,435,391

[45] Date of Patent: Jul. 25, 1995

[54] METHOD FOR FRACTURING AND PROPPING A FORMATION

[75] Inventor: Lloyd G. Jones, Dallas, Tex.

[73] Assignee: Mobil Oil Corporation, Fairfax, Va.

[21] Appl. No.: 286,367

[22] Filed: Aug. 5, 1994

[51] Int. Cl.[6] ..... E21B 43/267; E21B 43/04

[52] U.S. Cl. ..... 166/308; 166/280; 166/278

[58] Field of Search ..... 166/308, 259, 271, 278, 166/51, 269, 280

[56] References Cited

U.S. PATENT DOCUMENTS

| | | | |
|---|---|---|---|
| 3,730,273 | 5/1973 | Wilson | 166/269 |
| 4,842,068 | 6/1989 | Vercaemer et al. | 166/269 |
| 4,867,241 | 9/1989 | Strubhar | 166/308 |
| 4,945,991 | 8/1990 | Jones | 166/278 |
| 5,082,052 | 1/1991 | Jones et al. | 166/51 |
| 5,113,935 | 5/1992 | Jones et al. | 166/51 |
| 5,161,613 | 11/1992 | Jones | 166/242 |
| 5,161,618 | 11/1992 | Jones et al. | 166/308 |

*Primary Examiner*—Stephen J. Novosad
*Attorney, Agent, or Firm*—Alexander J. McKillop; George W. Hager, Jr.

[57] ABSTRACT

A method for fracturing and propping a thick and/or non-homogeneous fracture interval of a subterranean formation which is traversed by a wellbore. A workstring is lowered into the wellbore and a fracturing fluid is flowed into one end of the fracture interval annulus (i.e. that portion of the well annulus which lies adjacent the fracture interval) to initiate a fracture. The flow of fracturing fluid is ceased and a slurry containing proppants is flowed into said one end of the fracture interval annulus. During flow of fracturing fluid and slurry into said one end of the annulus, both are delivered through alternate flowpaths to different levels within said fracture interval. Alternate slugs of fracturing fluid and slurry is continued through the same end of the annulus until all of the levels or zones within the fracture interval have been fractured and propped and in some instances, also gravel-packed.

14 Claims, 4 Drawing Sheets

METHOD FOR FRACTURING AND PROPPING A FORMATION

DESCRIPTION

1. Technical Field

The present invention relates to a method for fracturing and propping a subterranean formation and in one of its aspects relates to a method for completing a fracture interval in a subterranean formation wherein alternate flow paths are used to deliver alternating slugs of a fracturing fluid and a slurry which contains proppants (e.g. gravel) to different levels within the fracture interval to thereby initiate, extend, prop, and in some instances, gravel pack the fracture interval throughout substantially its entire thickness.

2. Background Art

"Hydraulic fracturing" is a well known technique commonly used to increase the productivity of tight subterranean formations which produce hydrocarbon fluids or the like. In a typical hydraulic fracturing operation, a fracturing fluid (e.g. gel) is pumped down a wellbore and into the formation at a pressure sufficient to initiate a "fracture". The fracture(s) provides a network of permeable channels into the formation through which formation fluids can flow into the wellbore.

Unfortunately, however, such fractures have a tendency to close once the fracture pressure is relaxed. Accordingly, it is routine in the art to "prop" the fractures open by mixing proppants (e.g. sand, gravel, or other particulate material) with the fracturing fluid or by following the fracturing fluid with a slurry which contains the desired "props" or proppants. The slurry flows into the fractures where the props are deposited to thereby "prop" or hold the fractures open after the pressure is relaxed and the well is put on production.

As will be understood by those skilled in this art, problems remain in adequately fracturing and propping some formations, especially where the formation to be fractured is relatively thick (e.g. 50 feet or more) and/or is comprised of highly non-homogeneous strata. For example, in thick formations, it is difficult to initiate or extend a fracture across a second zone of the formation once a substantial fracture has been initiated in a first zone thereof (i.e. the "first" zone being the strata with lowest "break-down" pressure).

As the pressure increases in the wellbore, the fracturing fluid and/or slurry will normally take the path of least resistance and merely flow into the first zone thereby enlarging the initial fracture rather than initiating a new fracture or extending the initial fracture across a second zone of the formation. Further, it is common to lose liquid from the slurry into the initial fracture which, in turn, causes the props, e.g. sand, to collect in the well annulus adjacent the initial fracture thereby forming a "sand bridge" in the annulus.

These sand bridges block further flow of fracturing gel and/or slurry through the well annulus thereby preventing the further delivery of the necessary fluids to other levels or zones within the interval to be fractured. This is true even where some of these other zones may have previously experienced some break-down before a sand bridge was formed. The formation of sand bridges-during the fracturing operation usually results in fractures which extend only across a portion of the desired fracture interval and/or in fractures which are inadequately propped. In either event, the benefits of the fracturing operation are not fully realized.

Due to the problems associated with the formation of sand bridges in the well annulus, currently it is common to use a series of individual, conventional fracturing operations to fracture and prop thick formations and/or non-homogeneous formations. That is, a workstring, packers, and other associated equipment are lowered into the wellbore and the wellbore is packed-off and isolated adjacent a first zone within the fracture interval. Fracturing fluid and/or slurry is then flowed down the wellbore to fracture and prop the isolated first zone of the fracture interval.

The packers are then released and the equipment is moved within the wellbore to a second zone of the fracture interval which is then isolated, fractured, and propped as before. This procedure is repeated until the fractures extend across substantially the entire thickness of the fracture interval or until all of the non-homogenous zones within the fracture interval have been fractured and propped. Of course, as will be recognized by those skilled in the well completion art, this repetition of these individual, conventional fracturing and propping operations in a single well is extremely expensive and time consuming and seriously affects the overall economics involved in the completing and producing a well.

To overcome the expense and time involved in having to carry out a series of individual fracturing operations to fracture and prop a thick and/or non-homogeneous interval, methods have been proposed wherein the fracturing of such an interval can be performed in a single operation; for example see U.S. Pat. No. 5,161,618 to Jones et al. Another fracturing and propping operation of this type is disclosed in copending U.S. patent application Ser. No. 08/254,623, filed Jun. 6, 1994, wherein a fracturing fluid is pumped into one end of the well annulus adjacent the fracture interval while a slurry is pumped through the other end of the annulus. As the formation is fractured and propped and sand bridges are formed within the annulus, the fracturing fluid and/or slurry is delivered past the sand bridges to different levels within the interval through alternate flowpaths which extend throughout the interval. The present invention provides still another method for fracturing and propping a formation in a single operation.

SUMMARY OF THE INVENTION

The present invention provides a method for fracturing and propping a thick and/or non-homogeneous fracture interval of a subterranean formation which is traversed by a wellbore. Basically, the method is carried out by lowering a workstring in the wellbore which forms a well annulus between the workstring and wellbore. The portion of the workstring which extends through the fracture interval includes alternate flowpaths for carrying fluids to different levels therein.

With the workstring in position, a first slug of fracturing fluid is flowed into one end of that portion of the well annulus which is adjacent the fracture interval to initiate a fracture in the fracture interval. The flow of fracturing fluid is then ceased and a first slug of slurry containing proppants is flowed into the same end of the fracture interval to deposit the proppants in the fracture. The flow of slurry is then ceased and a second slug of fracturing fluid is injected into the same end of the isolated annulus.

If a sand bridge forms in the annulus as proppants are being deposited in the fracture, the second and any additional slugs of fracturing fluid are delivered around the sand bridge(s) through the alternate flowpaths to therey enlarge and extend the fracture or to initiate a new fracture within the fracture interval. A second slug of slurry is then. injected after the second slug of fracturing fluid and is also delivered around any sand bridge(s) in the annulus through the alternate flowpaths to deposit proppants in the enlarged portion of the fracture.

These steps of alternating the injection of fracturing fluid and slurry are continued until substantially the entire length of the fracture interval has been fractured and propped. This allows thick and/or non-homogeneous fracture intervals to be fractured and propped in a single operation thus eliminating the need for the series (commonly called "stages") of individual fracturing operations.

More specifically, a fracturing workstring is positioned within a wellbore substantially adjacent the interval to be fractured. The fracturing workstring may be comprised of a string of tubing or preferably be one which includes a cross-over and a gravel pack screen. A plurality of shunt tubes are spaced around the screen and extend throughout fracture interval and have openings therein which provide "alternate flowpaths" for the delivery of fluids to different levels within the fracture interval.

In operation, the well screen is positioned adjacent the fracture interval and forms an annulus with the wellbore. The portion of the annulus adjacent the fracture interval is isolated by setting a packer or the like. A relatively small slug of fracturing fluid is flowed down the wellbore and into one end (preferably the top or upper end) of the fracture interval annulus to initiate a fracture in the fracture interval.

The flow of fracturing fluid is then ceased and is replaced with the flow of a slurry which is laden with proppants (e.g. gravel and/or sand) to deposit proppants into the fracture. The flow of slurry, in turn, is ceased and a second slug of fracturing fluid is flowed into the top of annulus. As proppants begin to fill the fracture, a sand bridge normally forms in the annulus. The second slug of fracturing fluid, if blocked by such a sand bridge, will flow through the "alternate flowpaths" provided by shunt tubes into the annulus below the sand bridge to thereby enlarge or extend the fracture. Again, the flow of fracturing fluid is ceased and a second slug of slurry is pumped through the same path into the top of the annulus and through the alternate flowpath to deposit proppants into the extended fracture.

The alternating injection of small slugs of fracturing fluid and slurry is continued until a final high pressure sand off is obtained which indicates that substantially the entire fracture interval has been fractured and propped and that the annulus around screen is filled thereby forming a highly effective, gravel-pack completion across the fracture interval. By using small, alternating slugs of fracturing fluid and slurry, substantially lesser amounts of fluids are anticipated to be required to fracture, prop, and gravel-pack a fracture interval than are normally required in known prior art processes to fracture, prop, and gravel-pack the same fracture interval. This translates into significant savings in the economics of completing and producing a well.

BRIEF DESCRIPTION OF THE DRAWINGS

The actual construction, operation, and the apparent advantages of the present invention will be better understood by referring to the drawings in which like numerals identify like parts and in which.

BEST KNOWN MODE FOR CARRYING OUT THE INVENTION

Figure 1:
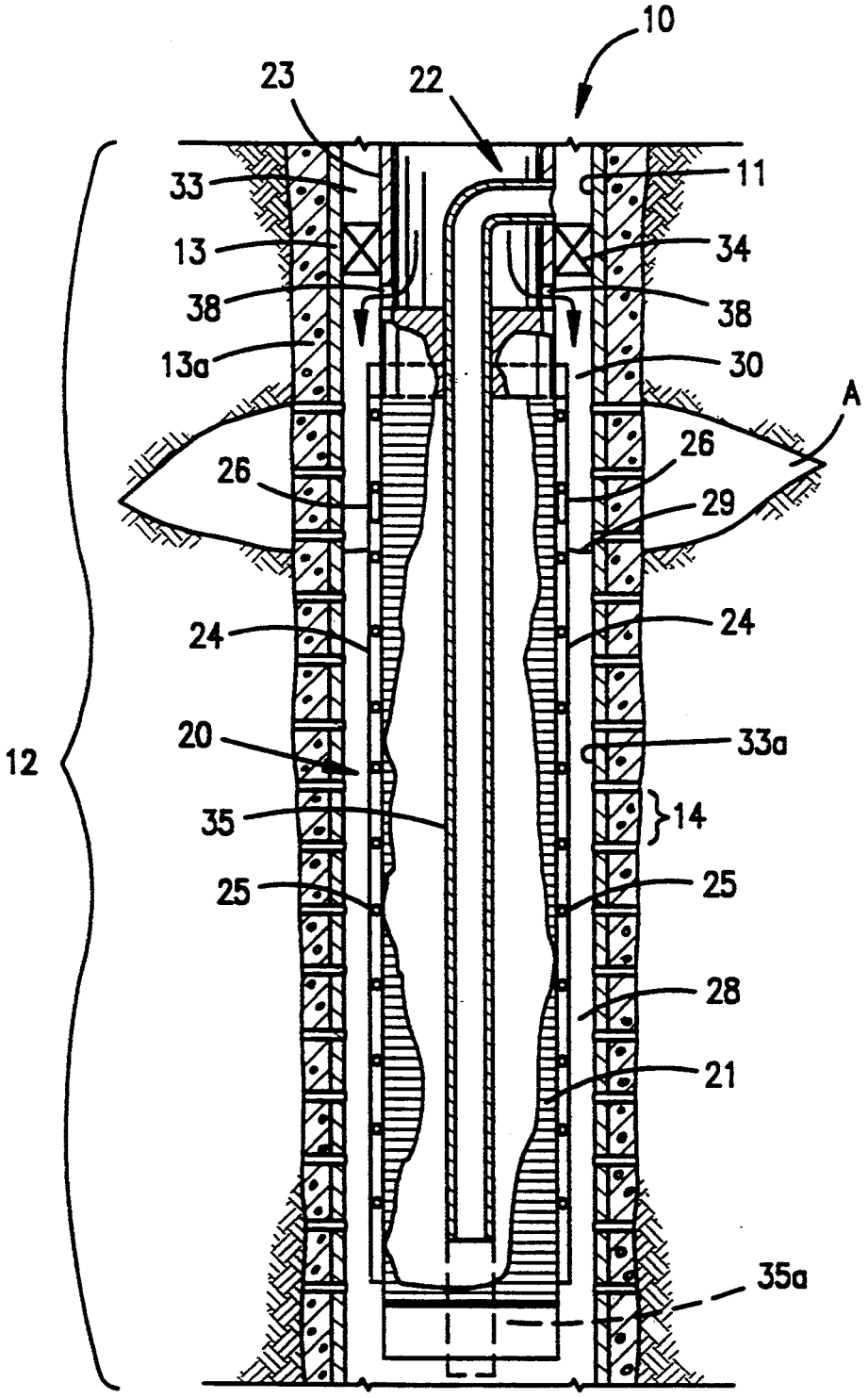
FIG. 1 is an elevational view, partly in section, of the lower portion of an apparatus used in carrying out the present invention as shown in an operable position within a wellbore adjacent a fracture interval wherein a fracture has been initiated within the fracture interval.

Referring more particularly to the drawings, FIG. 1 illustrates the lower end of a producing and/or injection well 10. Well 10 has a wellbore 11 which extends from the surface (not shown) through a fracture interval 12. Wellbore 11 is typically cased with a casing 13 which, in turn, is secured in place by cement 13*a*. While the method of the present invention is illustrated primarily as being carried out in a vertical cased wellbore, it should be recognized that the present invention can equally be used in open-hole and/or underreammed completions as well as in inclined and horizontal wellbores.

As illustrated, fracture interval 12 is a formation having a substantial length or thickness which extends vertically along wellbore 11. Casing 13 may have perforations 14 throughout fracture interval 12 or may be perforated at selected levels within the fracture interval. Since the present invention is also applicable for use in horizontal and inclined wellbores, the terms "upper and lower", "top and bottom", as used herein are relative terms and are intended to apply to the respective positions within a particular wellbore while the term "levels" is meant to refer to respective positions lying along the wellbore between the terminals of the fracture interval 12.

A fracturing workstring is positioned in wellbore 11 substantially adjacent fracture interval 12. The fracturing workstring may be comprised of a string of tubing or the like (not shown) extending from the surface and having means for providing alternate flowpaths through the fracture interval (e.g. see the workstring disclosed in U.S. copending application, Ser. No. 08/254,623, filed Jun. 6, 1994, which is incorporated herein by reference) or, as illustrated, the workstring 20 may be one which is to be used to "gravel-pack" the well.

Workstring 20 includes a gravel pack screen 21 which is connected through a conventional "cross-over" 22 onto the lower end of tubing string 23. "Gravel pack screen" or "screen" as used herein, is intended to be generic and to include screens, slotted pipes, screened pipes, perforated liners, pre-packed screens and/or liners, combinations of same, etc. which are used in well completions of this general type. Screen 21 may be of a continuous length, as shown, or it may be comprised of a plurality of screen segments connected together by subs or "blanks".

A plurality of shunt tubes 24 are spaced radially around and extend longitudinally along screen 21 substantially throughout fracture interval 12. Each of shunt tubes 24 has a plurality of openings 25 spaced along its length which provide "alternate flowpaths" for the delivery of fluids to different levels within the fracture interval 12 for a purpose to be discussed in detail below. Each shunt tube may be open at both of its ends to allow fluids to enter therein or the entry of fluid may be provided through some of the openings 25, themselves (e.g. those near the top and bottom of the tube). Shunts tubes of this type have been used to provide alternate flowpaths for fluids in a variety of different well operations, see U.S. Pat. Nos. 4,945,991; 5,082,052; 5,113,935; 5,161,613; and 5,161,618.

While openings 25 in each of the shunt tubes 24 may be a radial opening extending from the front of the tube, preferably the openings are formed so that they exit through each side of the shunt tube 24, as shown. Further, it is preferred that an exit tube 26 (only two shown in FIG. 1) is provided for each opening 25. The construction and purpose for exit tubes 26 is fully disclosed and claimed in applicant's co-pending U.S. application, Ser. No. 08/155,513, filed Nov. 22, 1993, which is incorporated herein by reference.

In operation, if wellbore 11 extends for a distance substantially below the bottom of fracture interval 12, the wellbore is blocked-off adjacent the lower end of fracture interval 12 by a plug or packer (not shown), as will be understood in the art. Workstring 20 is lowered into wellbore 11 which, in turn, forms a well annulus 33 between workstring 20 and the wellbore 11. The gravel pack screen 21 is positioned adjacent fracture interval 12 and packer 34, which is carried on the workstring, is set to isolate that portion 33*a* of the annulus which lies adjacent fracture interval 12. As will be understood by those skilled in the art, wellbore 11 and workstring 20 will be filled with the completion fluid that is normally present in wellbore 11 as workstring 20 is lowered therein.

With workstring 20 in place, a fracturing fluid is flowed down the wellbore and into the annulus adjacent the fracture interval. While the fluid may be flowed down annulus 33, through washpipe 35, and out the bottom of screen 21 (through extended washpipe 35*a*, dotted lines in FIG. 1) to fill the annulus 33*a* from the bottom up, it is preferred to flow the fluid 30 down through tubing 22, out ports 38 of cross-over 21, and into the top of annulus 33*a*. This is preferred since a smaller volume of fluid has to be handled to accomplish the same objective, i.e. fill annulus 33*a*.

After the fracturing fluid 30 begins to flow into the top of the annulus 33a, annulus 33 is shut in at the surface. The fracturing fluid 30 can be any well-known fluid commonly used for fracturing formations (e.g. water, muds, etc.) but preferably is one of the many commercially-available substantially, particle-free "gels" which are routinely used in conventional fracturing operations (e.g. Versagel, product of Halliburton Company, Duncan, Okla.). The fracturing fluid 30 flows into the top of the annulus 33*a* and is effectively blocked from further downward flow by the now-blocked, completion fluid 28 remaining therein (see interface 29 in FIG. 1). Continued pressure on the fracturing fluid 30 forces it through the upper few perforations 14 into the formation to initiate a fracture A in the fracture interval.

Figure 2:
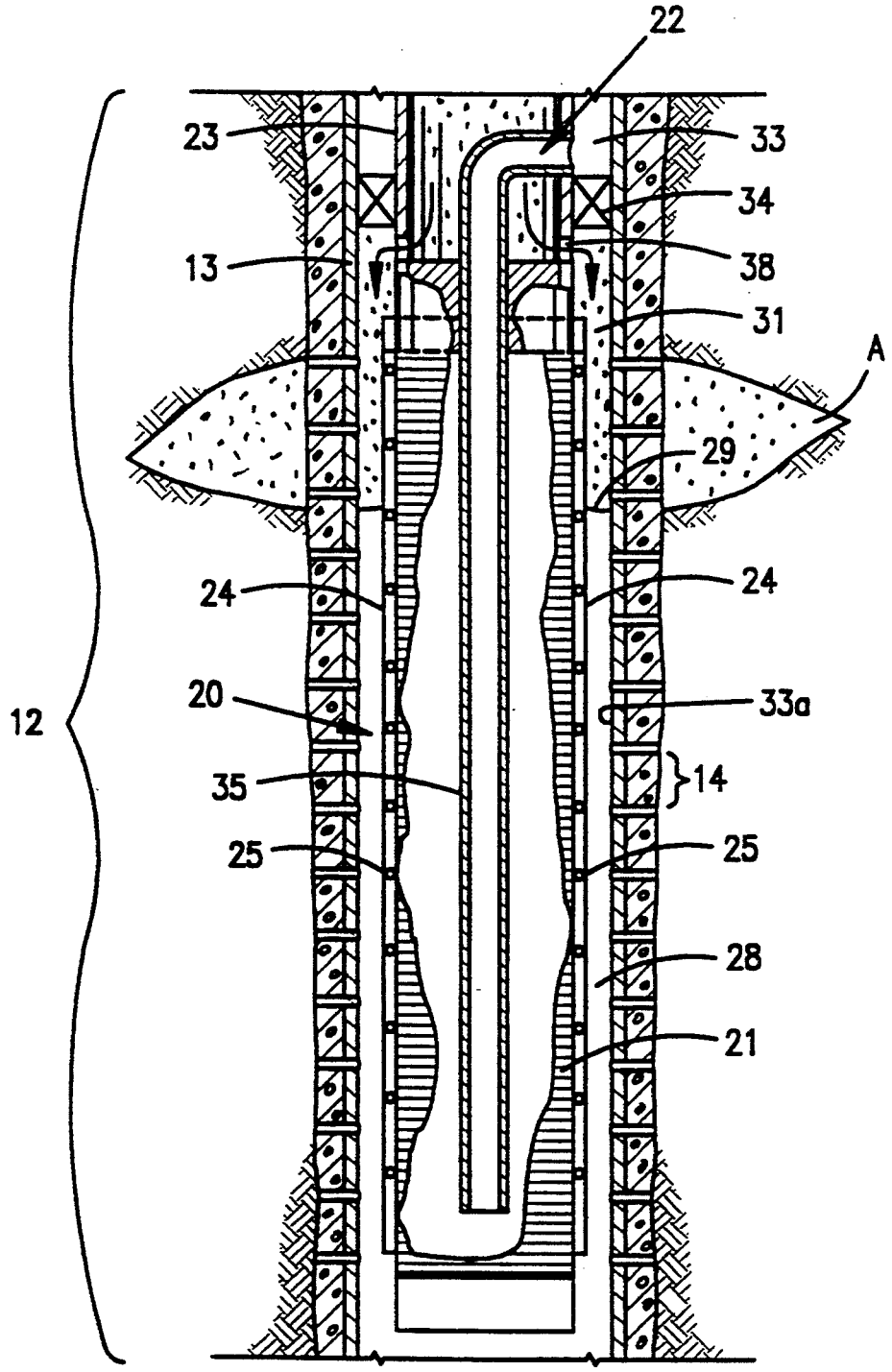
FIG. 2 is an elevational view, partly in section, similar to that of FIG. 1, wherein the initial fracture is being propped with proppants.

It will be understood that a small volume of the completion fluid around interface 29 may be forced ahead of or along with the fracturing fluid through the perforations 14 into the formation but this fluid will not adversely affect the initiation of the fracture A. Now referring to FIG. 2, once the fracture A has been initiated, the flow of fracturing fluid 30 is replaced with the flow of a slurry 31 which is laden with proppants (e.g. gravel and/or sand). The slurry flows through the top of annulus 33*a* into fracture A where it deposits the proppants. The volumes of both the fracturing fluid and the slurry will normally be relatively small, i.e. a slug of a few barrels each. In most instances, it will be advantageous to use separate systems for alternately pumping the slugs of fracturing fluid and slurry although a single pumping system can be used by switching the inlet of the pump between tanks containing the fracturing fluid and tanks containing the slurry.

Periodically, the flow of slurry is ceased and another small slug of fracturing fluid 30 (e.g. as little as a barrel) is flowed into the top of annulus 33*a*. As fracture A becomes filled with proppants, a sand bridge 55 (FIG. 4) normally will form in annulus 33a adjacent the fracture A. Any slug of fracturing fluid 30 other than the first slug entering the top of annulus 33*a* may be blocked by bridge(s) 55, if present, but can still flow through the "alternate flowpaths" provided by shunt tubes 24 and out the first few openings 25 which lie just below bridge 55 and above interface 29. If necessary, annulus 33 can be temporarily opened to take a small amount of return of completion fluid 28 to thereby lower interface 29 in annulus 33*a* as the fracturing and propping operation proceeds.

Figure 3:
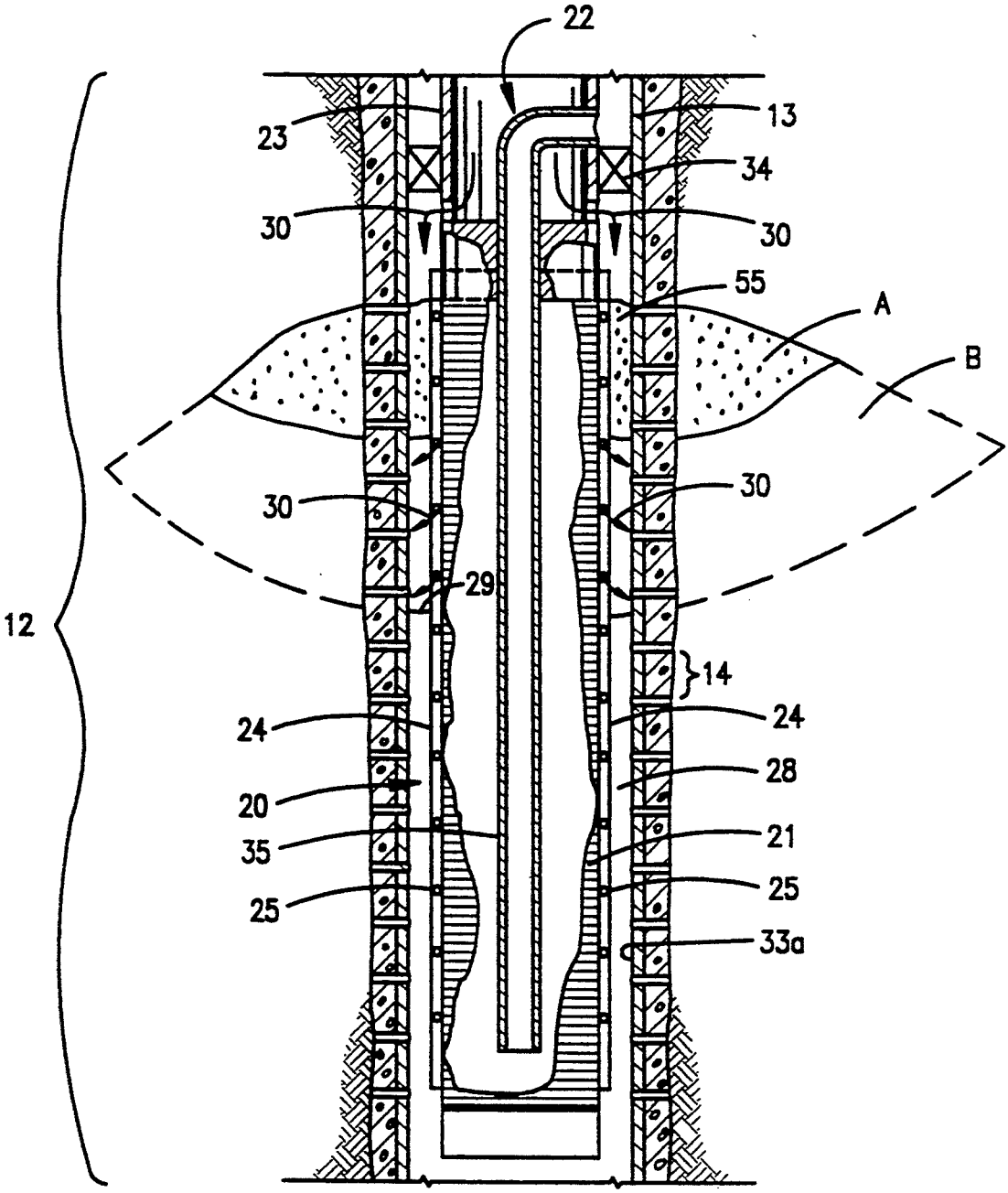
FIG. 3 is an elevational view, partly in section, similar to that of FIG. 1, wherein the initial fracture is being extended with an additional slug of fracturing fluid.

As illustrated in FIG. 3, following the formation of sand bridge 55, the second and/or any subsequent slug(s) of fracturing fluid 30 flows from openings 25 in shunt tubes 24 into fracture interval 12 to enlarge or extend initial fracture A and thereby creating a larger fracture B or to create a new fracture further along the fracture interval 12. A reduced pump rate for either the fracturing fluid and/or the slurry can be used to control the size of the fracture being formed.

Once a subsequent (e.g. second) slug of fracturing fluid 30 is pumped and the fracture has been extended, additional (e.g. second) slug(s) of slurry (not shown) is pumped through the same path into the extended fracture B or any newly created fracture(s) to deposit proppants and prop the fracture(s). Preferably, the rate of the slurry is reduced to encourage sanding off the fracture extension created by the prior slug of fracturing fluid.

The injection of alternating slugs of fracturing fluid and slurry is continued until a final high pressure sand off is obtained which indicates that substantially the entire fracture interval 12 has been fractured and propped and that annulus 33*a* around screen 21 is filled with proppants thereby forming a highly effective, gravel-pack completion across the fracture interval.

It should be noted that if the present invention is being carried out in a relatively tight formation (e.g. a formation having a rock-like matrix), normally a gravel-pack completion will not be required. In such instances, it may be desirable to remove workstring 20 after the fracturing and propping of interval 12 is completed and this can be done by washing out the workstring such as shown in co-pending U.S. application Ser. No. 08/254,623, filed Jun. 6, 1994.

In some instances, it may be desirable to insure that the fracturing of interval 12 takes place from the top towards the bottom thereof. In that event, a highly-viscous well fluid 40 will be pumped down tubing 22 to displace the completion fluid 29 from annulus 33*a* and the interior of screen 21. After viscous fluid 40 enters the lower end of washpipe 35, annulus 33 is shut in at the surface. Viscous fluid 40 may be selected from any well fluid of this type which has a high viscosity (e.g. a downhole viscosity of about 500 cps or greater) but is readily pumpable with standard equipment.

Preferably, viscous fluid 40 is formulated from the same commercially-available substantially, particle-free "gels" as are preferred for formulating fracturing fluid 30 but will be in higher concentrations than when used for the fracturing fluid 30 which will typically have a downhole viscosity of about 300 cps.

Figure 4:
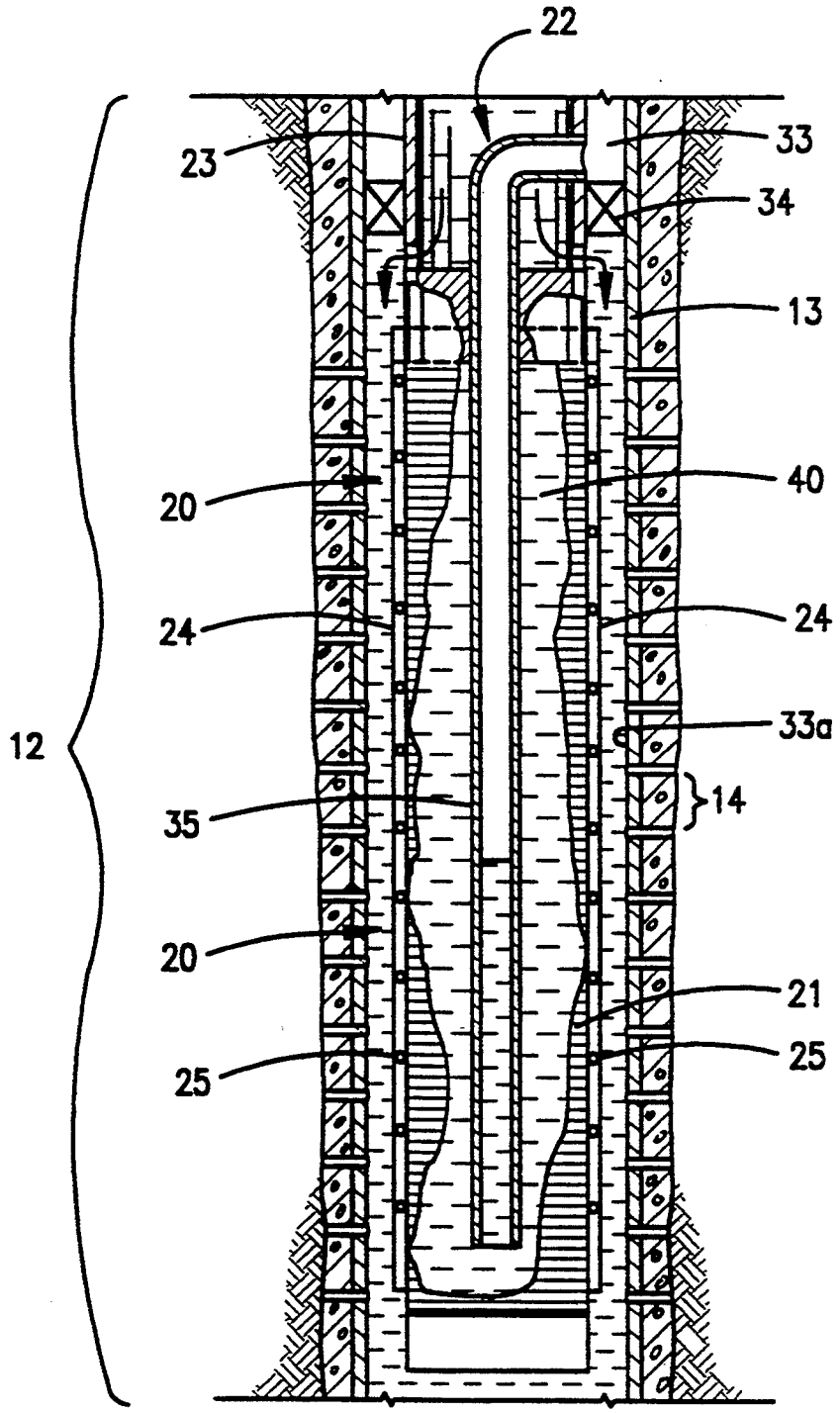
FIG. 4 is an elevational view, partly in section, similar to that of FIG. 1, with the annulus adjacent the fracture interval being filled with a viscous fluid.

After annulus 33*a* is filled with viscous fluid 40 as shown in FIG. 4, a relatively small volume (e.g. few barrels) of fracturing fluid 30 (not shown) is flowed down tubing 22, out ports 38 in cross-over 21, and into the top of annulus 33*a* where it come into contact with and is resisted by stiff, viscous fluid 40. Annulus 33 may be temporarily open to take further returns to allow the viscous interface to drop in annulus 33*a* or the viscous fluid 40 may be forced into the formation ahead of the fracturing fluid.

In some instances, it may be desirable to pump a very small amount of an acid (e.g. a fraction of a barrel of 15% hydrochloric acid) ahead of the fracturing fluid to stimulate a first short section of interval 12 which is to be initially fractured and/or to reduce the viscosity of the stiff, viscous fluid 40 across the first few perforations 14 adjacent this first section. The flow of the fracturing fluid downward through annulus 33*a* is resisted by the viscous fluid 40 in the same manner as did the completion fluid 28 (except more so) and is forced through the upper few perforations 14 into the formation to initiate a fracture in the fracture interval.

Again, it will be understood that a small volume of the viscous fluid 40 may be forced ahead of or along with the fracturing fluid (not shown in FIG. 4) through the perforations 14 but this small amount will not substantially interfere with the fracturing fluid as it a initiates a fracture in interval 12. Again, the viscous fluid 40 provides a barrier which prevents the fracturing fluid from flowing downward in the annulus 33*a*.

The remainder of the fracturing operation is basically the same as described above in relation to FIGS. 13 in that once a fracture has been initiated, the flow of fracturing fluid is replaced with the flow of a slurry to deposit proppants into the initial fracture. Again, the volume of slurry will normally be relatively small, i.e. a few barrels. Once propping of the fracture has been initiated, another small slug (e.g. second slug) of fracturing fluid (e.g. as little as a barrel) is flowed into the top of annulus 33*a* and through the "alternate flowpaths" provided by shunt tubes 24 to thereby bypass any sand bridges which may be have been formed in annulus 33*a* during the flow of the slurry.

Again, it may be desirable to flow a small volume of acid ahead of any subsequent slug(s) of fracturing fluid to stimulate the second short portion of interval 12 to be fractured and/or to reduce the viscosity of the stiff fluid 40 which lies adjacent the perforation 14 through which the fracturing fluid is to pass. After each slug of fracturing fluid is pumped and the fracture has been extended, a slug of slurry is alternately pumped through the same path through the top of the annulus 33*a* and into the extended fracture to deposit proppants in the fracture. Preferably, the rate of the slurry is reduced to encourage sanding off the fracture extension created by the prior slug (s) of fracturing fluid.

The injection of small, alternating slugs of fracturing fluid and slurry is continued as described above until a final high pressure sand off is obtained which indicates that substantially the entire fracture interval 12 has been fractured and propped and that annulus 33*a* around screen 21 is filled thereby forming an efficient gravel-pack completion adjacent the fracture interval 12.

Again, if a gravel-pack completion is not required, the workstring can be washed out and removed from the wellbore as described above. By using small, alternating slugs of fracturing fluid and slurry, substantially lesser amounts of fluids are required to carry out the operation which translates into significant savings in the economics of completing and producing a well.

What is claimed is:

1. A method for fracturing and propping a fracture interval of a subterranean formation which is traversed by a wellbore, said method comprising:

positioning a workstring in the wellbore to form a well annulus between said workstring and said wellbore;

flowing a first slug of fracturing fluid into one end of that portion of said well annulus which lies adjacent to said fracture interval to thereby initiate a fracture in said fracture interval;

ceasing the flow of fracturing fluid;

flowing a first slug of slurry containing proppants into said one end of said fracture interval annulus to deposit said proppants in said fracture;

ceasing flow of said slurry;

flowing at least a second slug of fracturing fluid into said one end of said fracture interval annulus and delivering said fracturing fluid through alternate flowpaths to different levels within said fracture interval to thereby enlarge and extend said fracture or to initiate a new fracture in said fracture interval;

ceasing the flow of said second slug of fracturing fluid; and flowing at least a second slug of slurry containing proppants into said one end of said fracture interval annulus to deposit proppants in said enlarged and extended fracture.

2. The method of claim 1 wherein said one end is the upper end of said fracture interval annulus.

3. The method of claim 1 including:

isolating said portion of said annulus which lies adjacent said fracture interval prior to flowing said fracturing fluid into at least one end of the fracture interval annulus.

4. The method of claim 3 wherein said workstring includes a cross-over and wherein said fracturing fluid and said slurry are alternately flowed down said workstring, out of said cross-over, and into the upper end of said isolated fracture interval annulus to thereby alternately fracture and prop said fracture interval.

5. The method of claim 4 wherein said alternate flowpaths are provided by shunt tubes which are spaced radially around said workstring and which extend through said fracture interval, each of said shunt tubes having inlet and outlet openings spaced along its length.

6. The method of claim 1 wherein said fracturing fluid is a fracturing gel and said proppants are sand.

7. The method of claim 1 including:

continuing to alternate flow of fracturing fluid and slurry through said one end of said fracture interval until substantially the entire said fracture interval is fractured and propped.

8. A method for fracturing, propping, and gravel-packing a fracture interval of a subterranean formation which is traversed by a wellbore, said method comprising:

positioning a workstring in the wellbore to form a well annulus between said workstring and said wellbore, said workstring including a gravel pack screen which lies adjacent said fracture interval to form a fracture interval annulus when said workstring is in place within said wellbore;

flowing a fist slug of fracturing fluid into one end of that portion of said well annulus which lies adjacent to said fracture interval to thereby initiate a fracture in said fracture interval;

ceasing flow of said fracturing fluid;

flowing a first slug of slurry containing proppants into said one end of said fracture interval annulus to deposit proppants in said fracture;

ceasing flow of said slurry;

flowing at least a second slug of fracturing fluid into said one end of said fracture interval annulus and delivering said fracturing fluid through alternate flowpaths to levels within said fracture interval to thereby enlarge and extend said fracture;

ceasing flow of said second slug of fracturing fluid; and flowing at least a second slug of slurry containing proppants into said one end of said fracture interval annulus to deposit proppants in said enlarged and extended fracture.

9. The method of claim 8 wherein said one end is the upper end of said fracture interval annulus.

10. The method of claim 8 including:

isolating said portion of said annulus which lies adjacent said fracture interval prior to flowing said fracturing fluid into one end of the fracture interval annulus.

11. The method of claim 10 wherein said workstring includes a cross-over and wherein said fracturing fluid and said slurry are alternately flowed down said workstring, out of said cross-over, and into the top of said isolated fracture interval annulus to thereby fracture and prop said fracture interval.

12. The method of claim 8 wherein said alternate flowpaths are provided by shunt tubes which are spaced radially around said workstring and which extend through said fracture interval, each of said shunt tubes having inlet and outlet openings spaced along its length.

13. The method of claim 8 wherein said fracturing fluid is a fracturing gel and said proppants are sand.

14. The method of claim 8 including:

continuing to alternate flow of fracturing fluid and slurry through said one end of said fracture interval until substantially the entire said fracture interval is fractured, propped, and gravel packed.

* * * * *